United States Patent [19]

Frick

[11] 4,421,475

[45] Dec. 20, 1983

[54] BURNER FOR THE COMBUSTION OF LIQUID FUELS IN THE GASEOUS STATE

[75] Inventor: Adolf Frick, Balzers, Fed. Rep. of Germany

[73] Assignee: Stoechio-matic AG, Schaan, Fed. Rep. of Germany

[21] Appl. No.: 241,976

[22] Filed: Mar. 9, 1981

[30] Foreign Application Priority Data

Mar. 14, 1980 [CH] Switzerland ..... 2001/80

[51] Int. Cl.[3] ..... F23D 11/44

[52] U.S. Cl. ..... 431/207; 431/208; 48/103

[58] Field of Search ..... 431/207, 208; 48/103 A

[56] References Cited

U.S. PATENT DOCUMENTS

| | | | |
|---|---|---|---|
| 1,349,923 | 8/1920 | Smith . | |
| 1,367,947 | 2/1921 | Chadick . | |
| 2,925,329 | 2/1960 | Yost | 48/103 |
| 2,982,528 | 5/1961 | Shelton | 48/103 |
| 3,326,262 | 6/1967 | Weller, Jr. et al. | 431/161 |
| 3,640,673 | 2/1972 | Okamoto et al. | 431/208 |
| 4,011,617 | 3/1977 | Toelke et al. | 15/104.04 |
| 4,013,396 | 3/1977 | Tenney | 431/208 |
| 4,023,538 | 5/1977 | Harpman et al. | 48/103 |
| 4,050,419 | 9/1977 | Harpman et al. | 48/103 |
| 4,106,891 | 8/1978 | Schladitz | 48/103 |
| 4,114,566 | 9/1978 | Harpman et al. | 48/103 |
| 4,145,998 | 3/1979 | Mahoney et al. | 48/103 |
| 4,249,885 | 2/1981 | Reich | 431/208 |

FOREIGN PATENT DOCUMENTS

| | | | |
|---|---|---|---|
| 74274 | 3/1893 | Fed. Rep. of Germany . | |
| 765255 | 6/1934 | France . | |
| 1193003 | 10/1959 | France | 431/208 |
| 1312447 | 11/1962 | France . | |
| 365353 | 12/1962 | Switzerland . | |
| 5830 | 12/1915 | United Kingdom . | |
| 237868 | 8/1925 | United Kingdom . | |
| 446050 | 4/1936 | United Kingdom . | |
| 1007942 | 10/1980 | United Kingdom . | |

*Primary Examiner*—Henry C. Yuen

*Attorney, Agent, or Firm*—Griffin, Branigan & Butler

[57] ABSTRACT

A burner has a gasification chamber (11) without air inlet openings so that the evaporation of fuel takes place essentially without air. A motor (15) drives wipers (17) which distribute the fuel over a heatable wall (19) of a gasification chamber 11 and remove deposits therefrom. A bellows (35) and a ventilator (45) comprise heat barriers between hot portions of the burner and the motor 15.

26 Claims, 1 Drawing Figure

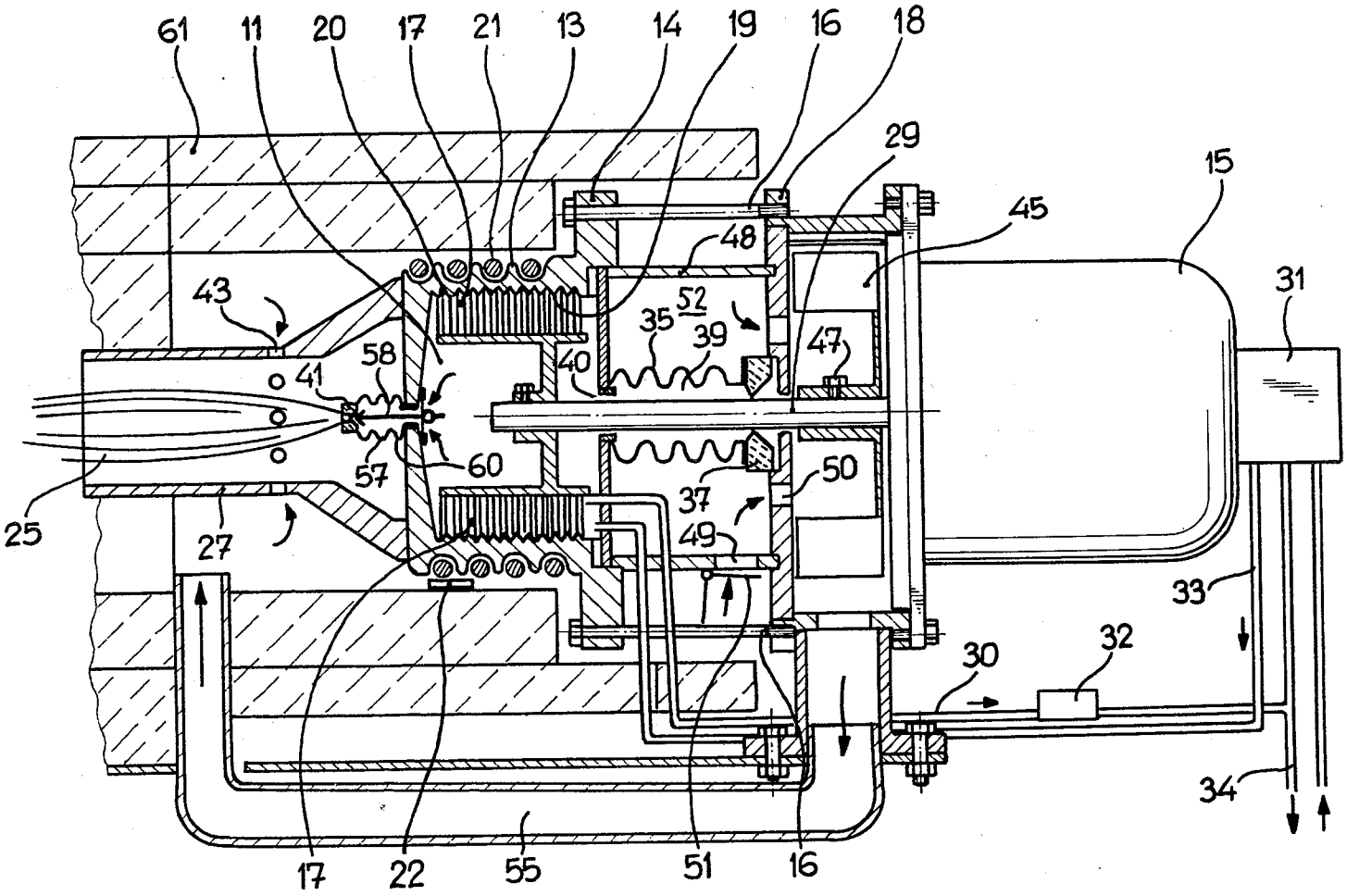
31
15
45
18
29
16
19
14
13
21
17
20
11
61
48
47
52
39
35
40
50
37
49
60
58
57
41
43
25
27
33
32
30
34
16
51
55
22
17

BURNER FOR THE COMBUSTION OF LIQUID FUELS IN THE GASEOUS STATE

BACKGROUND

This invention pertains to burners for the combustion of liquid fuels, and particularly to gasification burners which typically comprise a gasification chamber protected from a flame and having at least one heatable wall. Gasification burners generally make advantageous use of fuels and yield combustion gases which contain few pollutants (such as unburned fuel particles and soot particles).

European patent application No. 0 006 747 describes a burner in which liquid fuel together with air is fed into a helical duct. The liquid fuel enters a mixing chamber, is mixed with additional air, and escapes through openings in a burner plate, thereby creating a flame above the burner plate. This flame also warms the burner body and provides the necessary evaporation heat. The burner is started by heat from an electric heater coil.

Although relatively advantageous, burners such as the above-described nevertheless suffer from numerous deficiencies. Evaporation of fuel in the presence of air causes undesired deposits to form in the burner. These deposits interfere with efficient evaporation of the fuel. In prior art burners, these deposits often build up throughout various portions of the burner since such burners provide no means for confining the gasification temperature heat to the particular region in which gasification occurs. Moreover, the gasification burners currently available provide no satisfactory means for removing such deposits once they have built up in the gasification chamber.

Another example of a disadvantage of present day gasification burners pertains to the relatively short flame produced by such burners. Short flames are not well suited for many burner applications.

Accordingly, an object of the embodiments of this invention is to provide a gasification burner wherein gasification occurs essentially with an absence of air.

An advantage of the embodiments of this invention is the provision of a gasification burner with means for confining the optimal gasification temperature to an air-free gasification chamber.

Another advantage of the embodiments of this invention is the provision of a gasification burner with means for removing any undesirable deposits which may occur therein.

SUMMARY

A burner has a gasification chamber without air inlet openings so that the evaporation of fuel takes place essentially without air. A motor drives wipers which distribute the fuel over a heatable wall of a gasification chamber and remove deposits therefrom. The heatable wall is heated by an electric heating coil and in operation also partly by back feeding of heat from a flame to a housing of the gasification chamber. A bellows connected to the chamber housing radiates heat, so that a seal and the motor are not impaired by the heat. A ventilator is also active as a heat barrier between the hot burner parts and the motor.

BRIEF DESCRIPTION OF THE DRAWINGS

The foregoing and other objects, features, and advantages of the invention will be apparent from the following more particular description of preferred embodiments as illustrated in the accompanying drawing in which reference characters refer to the same parts throughout the various views. The drawing is not necessarily to scale, emphasis instead being placed upon illustrating the principles of the invention.

FIG. 1 is a cross-sectional view showing a burner according to a preferred embodiment of the invention.

DETAILED DESCRIPTION OF THE DRAWING

A burner comprises gasification chamber 11 formed by a housing 13. The housing 13, preferably fabricated of cast iron, has a flange 14 with screws 16 extending therethrough to connect housing 13 to a ventilator housing 18. The gasification chamber 11 has the form of a solid of rotation. Although the embodiment of the gasification chamber shown in the FIGURE is cylindrical in form, it could also have a different form, e.g. a conical form.

Housing 13 has an interior heatable wall 19. Wall 19 is provided with grooves 20 to increase the surface area of the wall. Electrical heating means, such as heating element 21 in form of a heating coil, encircle the housing 13 and are used to heat the wall 19. A temperature sensor 22 is provided proximate the housing 13 and is suitably connected to a control device (not shown).

Wiping means, such as wiper 17, is provided in the gasification chamber 11. In the embodiment shown two such wipers 17 are provided. Each wiper 17 comprises a steel brush or a brush of some other oil-resistant and wear-resistant material. As hereinafter described, the wipers 17 are adapted to sweep the heatable cylindrical wall 19. Wipers 17 are secured to a rotatable drive shaft 29 of a motor 15. The drive shaft 29 is concentrically located with respect to the gasification chamber 11.

Motor 15 is affixed to the housing 18. Between the motor 15 and the housing 13 of the gasification chamber 11 a buffer means of relatively poor heat conducting material (such as stainless steel) is provided. In the embodiment shown the buffer means comprises a tubular member or bellows 35. At the end of the tubular member 35 is a seal 37, which may be e.g. a labyrinth seal. This seal precludes gas from escaping from the gasification chamber 11 around the drive shaft 29.

Drive shaft 29 extends with little clearance through an opening 40 in the wall of the gasification chamber 11. Similarly, bellows 35 has only a slightly larger interior diameter than the diameter of the drive shaft 29. Accordingly, there is only a relatively small space 39 between the bellows 35 and the drive shaft 29. This small space 39 is in communication with the gasification chamber 11. Accordingly, some gasified fuel can enter into this space 39. However, as the drive shaft 29 extends with relatively little clearance through the opening 40, there is no large exchange of gas between the chamber 11 and the space 39.

The tubular member 35 is surrounded by a housing 48 having at least one air inlet 49 and at least one air outlet 50. Inlet 49 and outlet 50 are both in communication with ventilating means, such as a ventilator fan 45, located in housing 18. In this respect, ventilator fan 45 is mounted with a screw 47 on the drive shaft 29. The air supply into a space 52 defined by housing 48 can be selectively controlled by a flap 51 (schematically shown in the drawing).

Gasification chamber 11 has an output port in the form of a nozzle 41. In the embodiment shown a discharge valve 57 is provided at the nozzle 41. This discharge valve 57 is operated by over-pressure in the gasification chamber 11. The discharge valve has a concentric valve needle 58 and a bellows 60 which can be elongated by pressure in the chamber 11.

The nozzle 41 is surrounded by a flame tube 27. As shown in the FIGURE, flame tube 27 is affixed to or mounted on gasification chamber 11. The flame tube 27 has radial air intakes 43 through which air fed from the ventilator housing 18 through a canal 55 can flow to the flame. The ignition of the outflowing gas can take place in usual fashion, e.g. by an ignition electrode (not shown).

A fuel pump 31 driven by the motor 15 is mounted proximate the motor 15. A fuel supply line 33 leads from the pump 31 to the gasification chamber 11. A return line 30 exits from the gasification chamber and connects to a further return line 34. A solenoid valve 32 is connected on return line 30.

The hot parts of the burner, including the flame tube 27 and the gasification chamber 11, are essentially surrounded by an insulating member 61.

In operation, fuel is pumped by the motor-driven fuel pump 31 through the fuel supply line 33 and into the gasification chamber 11. Heat generated by the heating element 21 and (once ignited) the flame 25 heat the heatable wall 19 of the chamber 11, causing the fuel therein to gasify. Since the gasification chamber 11 has no air inlets, practically no air can enter into the gasification chamber 11 and gasification of the fuel takes place in the absence of air. In this way undesirable oxidation of fuel in the gasification chamber 11 is avoided, so that after a long operating time practically no solid products, such as carbonized products, are present in the burner.

Wiping means 17 rotate on drive shaft 29 and serve to distribute the fuel evenly in a thin layer on the heatable wall 19. The wiper 17 is preferably formed by a steel brush. Such steel brushes finely distribute the fuel and keep the chamber walls clean. To increase the surface area of the wall swept by the wiper the wall 19 contains grooves. Distribution of the fuel in this manner faciliates quick evaporation and avoids the formation of deposits on the wall 19 so that no impairing influence of deposits on the evaporation of fuel will occur. Moreover, when small amounts of solid products do form on the walls 19, they are wiped away by the rotating wiping means 17 in the form of fine dust which, together with the gas, leaves the gasification chamber through nozzle 41.

In operating gasification burners, it is desirable to maintain the gasification chamber 11 at an optimum gasification temperature and, for the most part, to confine this heat to the chamber 11. For this purpose, temperature sensor 22 (connected to a suitable but unillustrated control means, which in turn is connected to the heating element 21) is provided to monitor and maintain an optimal temperature in the gasification chamber 11.

In order to avoid any detrimental effect the heat of the gasification chamber 11 might have on the motor 15, which drives the wipers 17 through drive shaft 29, the motor 15 is located outside of the gasification chamber 11. Moreover, the tubular member 35, preferably fabricated of relatively poor heat conducting material, is provided between the gasification chamber and the motor with the seal 37 being at the end of the member 35. The tubular member 35 can radiate much heat so that practically no heat is conducted over the motor shaft 29 to the motor 15. The seal 37 maintains the relatively high pressure which must be generated in the gasification chamber 11. The location of the seal 37 at the end of the tubular member 35 also prevents the seal 37 from being subjected to unduly high temperatures.

To further prevent high temperatures near the seal 37 and the motor 15, the drive shaft 29 extends with little clearance through an opening 40 in the gasification chamber 11. The internal diameter of the tubular member 35 is slightly larger than the diameter of the drive shaft 29. Thus, only a little of the gas from the gasification chamber can enter the space 39 between the tubular member 35 and the drive shaft 29, so that within the tubular member 35 there is a substantially lower temperature than in the gasification chamber 11. At this low temperature the fuel is partly condensed. The condensation of small amounts of fuel has no ill effects, but rather provides lubrication for the seal 37.

Heat conduction over the drive shaft 29 is still further reduced in that the tubular member 35 does not extend to the motor flange, but terminates earlier to allow the placement of a ventilator 45 between the seal 37 and the motor 15. The air supplied from ventilator 45 causes a further cooling effect, so that the motor 15 is protected from excess heat. In this respect, the fan blades of the ventilator 45 rotate with the drive shaft 29.

The tubular member 35 is surrounded by a housing 48 having at least one air inlet 49 and at least one air outlet 52 leading to the ventilator 45. The flow of fresh air around the tubular member both cools the tubular member 35 and heats the intake air passing through the canal 55 to the flame 25, thereby increasing the efficiency of the burner. The air supply through the inlet 49 can be controlled by a flap 51. The air flowing into the space 52 provides an improved cooling of the bellows 35. Further, the air within the ventilator housing 48 contributes to an effective thermal insulation between the motor 15 and the hot parts of the burner.

Gas generated in the gasification chamber 11 is discharged at a relatively high velocity through the nozzle 41. The velocity depends mainly on the pressure in the gasification chamber 11 which, in turn, depends on the amount of fuel and the diameter of the nozzle 41. At relatively high pressure in the gasification chamber 11 the gas emerges with relatively high speed and provides the relatively long form of the flame, which is desired in most cases. The ignition of the outflowing gas takes place in the conventional fashion, such as by an ignition electrode (not shown).

The discharge valve 57 (comprising needle 58 and bellows 60) in the nozzle 41 is sensitive to overpressure in the interior of the gasification chamber 11 so that gas can only flow from the nozzle 41 when there is overpressure in the gasification chamber 11. It is therefore possible to extinguish the burner immediately by lowering the overpressure in the gasification chamber 11. This can be advantageously accomplished using the solenoid valve 32 to switch off the burner.

With reference to the operation of the discharge valve 57, if there is no pressure in the chamber 11 the valve 57 is closed. During overpressure in the chamber 11 the bellows 60 becomes elongated so that the valve opens and gas can stream out of the nozzle 41. On switching off the burner the solenoid valve 32 opens so that the pressure in the chamber decreases immediately, whereupon the valve 57 closes and the flame is extinguished.

Locating the flame tube 27 on the housing 13 of the gasification chamber 11 provides heat conduction from the flame tube 27 to the housing 13. However, the region of transition between the flame tube 27 and the housing 13 is preferably of such nature that no heat transfer exceeding the optimum gasification temperature is taking place to the housing 13 of the gasification chamber 11. This enables the temperature sensor 22 to control the heating element 21 in such a way that an optimal gasification temperature is maintained in the gasification chamber 11. The flame tube 27 is preferably provided with radial air inlets 43 such that air is warmed up before it contributes to the formation of the flame.

While the invention has been particularly shown and described with reference to the preferred embodiments thereof, it will be understood by those skilled in the art that various alterations in form and detail may be made therein without departing from the spirit and scope of the invention. For example, nozzle 41 may comprise other suitable valve means rather than a needle in a bellows.

The embodiments of the invention in which an exclusive property or privilege is claimed are defined as follows:

1. A burner for the combustion of liquid fuel in the gaseous state, said burner comprising:

a gasification chamber having at least one heatable wall heatable by heating means;

means for creating a relatively high pressure in the gasification chamber to prevent air from flowing into said gasification chamber and to discharge gasified fuel at a relatively high pressure;

means for permitting fuel to be introduced into said gasification chamber;

means for permitting gasified fuel to exit from said gasification chamber;

wiping means for cleaning said heatable wall of said gasification chamber; and, motor means located outside of the gasification chamber for actuating said wiping means inside of said gasification chamber to remove deposits from the gasification chamber walls so that said deposits exit from said gasification chamber with said gasified fuel.

2. The burner of claim 1 wherein said heating means is electrical.

3. The burner of claim 1 including temperature sensing means positioned proximate said chamber for maintaining an optimal gasification temperature therein.

4. The burner of claim 1, further comprising temperature sensing means proximate said gasification chamber, and wherein said heating means is responsive to said sensing means for maintaining an optimal gasification temperature in said gasification chamber.

5. The burner of claim 1, wherein said gasification chamber has the form of a solid of revolution, wherein said wiping means is connected to a drive shaft, and wherein said drive shaft is essentially concentrically positioned with respect to said chamber.

6. The burner of claim 5, wherein said gasification chamber is essentially cylindrical.

7. The burner of claim 5, wherein said gasification chamber is essentially conical.

8. The burner of claim 1, wherein said wiping means comprises a steel brush.

9. The burner of claim 1, wherein said heatable wall of said gasification chamber is provided with grooves.

10. The burner of claim 1, wherein said wiping means is connected to a drive shaft, wherein said drive shaft is connected to a motor outside of said gasification chamber, and wherein buffer means is provided between said motor and said gasification chamber.

11. The burner of claim 10, wherein said buffer means comprises a bellows member fitted over said drive shaft.

12. The burner of claim 11, wherein said bellows means comprises stainless steel.

13. The burner of claim 11, wherein said bellows member is sealed about said drive shaft by sealing means.

14. The burner of claim 11, wherein said bellows member is tubular-shaped, said bellows member having an internal diameter slightly larger than the diameter of said drive shaft.

15. The burner of claim 10, wherein ventilating means is provided between said motor and said buffer means.

16. The burner of claim 15, wherein said buffer means is essentially encased in a housing, and wherein said housing has at least one air inlet and at least one air outlet, said air inlet and said air outlet being in communication with said ventilating means.

17. The burner of claim 15, wherein said ventilating means comprises a fan connected to said drive shaft.

18. A burner of claim 1 wherein said means for permitting gasified fuel to exit from said gasification chamber is formed by a nozzle through which the gas exits at a relatively high velocity.

19. The burner of claim 18, wherein said nozzle is provided with valve means responsive to overpressure in the interior of said chamber.

20. The burner of claim 19, wherein said valve means comprises a bellows and a needle valve concentrical thereto.

21. The burner of claim 18, wherein a solenoid valve is connected to said gasification chamber, and wherein said solenoid valve selectably vents overpressure from said chamber.

22. The burner of claim 21, wherein said solenoid valve is connectable to a fuel return line, said fuel return line being in communication with said gasification chamber.

23. The burner of claim 1 wherein said means for permitting gasified fuel to exit from said gasification chamber is surrounded by a flame tube.

24. The burner of claim 23, wherein said flame tube is attached to a housing comprising said gasification chamber.

25. The burner of claim 24 including means to inhibit heat transfer from said flame tube to said gasification-chamber housing for preventing the temperature of said gasification chamber from exceeding an optimum gasification temperature.

26. The burner of claim 23, wherein said flame tube has radial air inlets.

* * * * *